United States Patent [19]

Serrano

[11] Patent Number: 4,557,045

[45] Date of Patent: Dec. 10, 1985

[54] INSULATING SLEEVE APPLYING APPARATUS

[75] Inventor: Pedro Serrano, Barcelona, Spain

[73] Assignee: AMP Incorporated, Harrisburg, Pa.

[21] Appl. No.: 677,784

[22] Filed: Dec. 4, 1984

[51] Int. Cl.[4] ..... H01R 43/00

[52] U.S. Cl. ..... 29/747; 29/742; 29/759; 29/760

[58] Field of Search ..... 29/742, 747, 753, 759, 29/760, 564.1, 564.6, 564.7, 564.8

[56] References Cited

U.S. PATENT DOCUMENTS 4,272,879 6/1981 Wigby et al. ..... 29/747 X 4,426,772 1/1984 Collier et al. ..... 29/742

*Primary Examiner*—Carl E. Hall

*Attorney, Agent, or Firm*—Jay L. Seitchik

[57] ABSTRACT

Apparatus for applying insulating sleeves to electrical terminals, comprises a frame having a horizontal surface on which is a terminal locator for locating in front of a sleeve applicator ram, a terminal on a lead transported horizontally by a conveyor. A lead capturing and terminal positioning member is moved towards the terminal locator to position the terminal therein and the applicator ram is advanced to apply a sleeve to the terminal. When the sleeve has been applied to the terminal by means of the ram and the ram has been retracted, an ejector throws the terminal with the sleeve thereon, vertically out of the terminal locator, and a sleeve feed ram feeds a further sleeve between the applicator ram and the terminal locator. The above operations take place during a dwell period of the conveyor.

11 Claims, 15 Drawing Figures

INSULATING SLEEVE APPLYING APPARATUS

This invention relates to apparatus for applying an insulating sleeve to an electrical terminal connected to an end of a wire lead.

The invention particularly concerns such apparatus which is suitable for use with an automatic lead making machine, having a lead transporting conveyor by means of which the ends of wire leads are presented, during dwell periods of the conveyor, to apparatus for applying electrical terminals to the lead ends and then to other lead end processing apparatus, alongside the conveyor. Such a machine is described, for example, in U.S. Pat. No. 2,768,425.

For many commercial applications, it is required that the terminals be insulated, by means, for example of insulating sleeves, applied to the terminals after they have been connected to the lead ends. Such a sleeve may be of the kind which is snap fitted to the terminal by virtue of cooperating detente means in the sleeve and on the terminal.

In providing sleeve applying apparatus for use with a lead making machine of the kind described above, the problem arises that since the end portions of the leads to which the terminals have been connected, project from the conveyor, for example, by a length of some inches, these end portions are difficult to handle, such difficulty increasing with the flexibility of the leads. Further, it must be insured that each terminal is rapidly released by the apparatus when a sleeve has been applied thereto, so that the conveyor can be advanced again with as little delay as possible.

Although apparatus for applying insulating sleeves to electrical terminals which have been connected to the ends of wire leads, are described in U.S. Pat. No. 3,667,102, U.S. Pat. No. 4,139,937, GB-A- No. 1,272,516 and GB-A- No. 1,575,619, all these apparatus are intended for the manual application of the lead ends thereto.

Apparatus, according to the invention, comprises a frame having thereon means for locating the terminal in a given position, means for capturing the lead wire proximate to the terminal, and for then positioning the terminal in the locating means, means for releasably retaining the terminal in the locating means, means for then applying the sleeve to the terminal, means for withdrawing the lead capturing and terminal positioning means and the retaining means from the locating means, and means for then ejecting the terminal with the sleeve thereon from the locating means.

Thus, where the apparatus is used with a lead making machine of the kind described above, the lead, which hangs loosely from the conveyor, is first captured, and is then placed in the terminal locating means, being retained therein whilst the sleeve is applied thereto. The wire lead capturing means and the retaining means are then withdrawn from the locating means, and the terminal with the sleeve thereon is finally ejected from the apparatus, so as to allow further advance of the conveyor. In practice the apparatus can be arranged to perform a complete cycle of operation in no more than one second.

The terminal locating means, may define a cavity for receiving the terminal, the cavity having a first mouth into which the terminal can be inserted by the wire capturing means and a second mouth through which the sleeve is inserted so as to receive the terminal therein.

The capturing and positioning means may be in the form of a plate having a slot for snugly receiving the wire lead and communicating with a flared mouth for capturing the lead and guiding it into the slot as the plate is moved towards the terminal locating means. The latter may have an opening opposite to the second mouth and communicating with the cavity, to receive the lead. Lead gripping surfaces may be provided on the plate and on the frame to grip the lead at a position back from the plate when the lead has been located in the slot thereof.

The means for releasably holding the terminal in the positioning means, may be in the form of a spring loaded rotary plate attached to a ram to which the wire lead capturing means is also attached for a movement towards and away from the terminal locating means, and the cavity may be provided with spring loaded side walls, between which the terminal is laid by the lead capturing and positioning means, these sidewalls and the rotary plate, being moved resiliently away from one another, as the sleeve is being applied to the terminal.

The apparatus may be arranged to be started by a signal emitted by the lead making machine, means for driving the parts of the apparatus being arranged thereafter to actuate one another sequentially and the apparatus being arranged to emit a signal, when sleeve application and ejection have been completed, to re-start the conveyor.

The ejector is preferably in the form of a ram arranged to drive the terminal, with the sleeve thereon, positively upwardly out of the terminal positioning means so that it is clear thereof.

Conveniently, the parts of the apparatus are driven by pneumatic piston and cylinder units although a pneumatic control circuit.

An embodiment of the invention will now be described, by way of example, with reference to the accompanying drawings in which.

Figure 11:
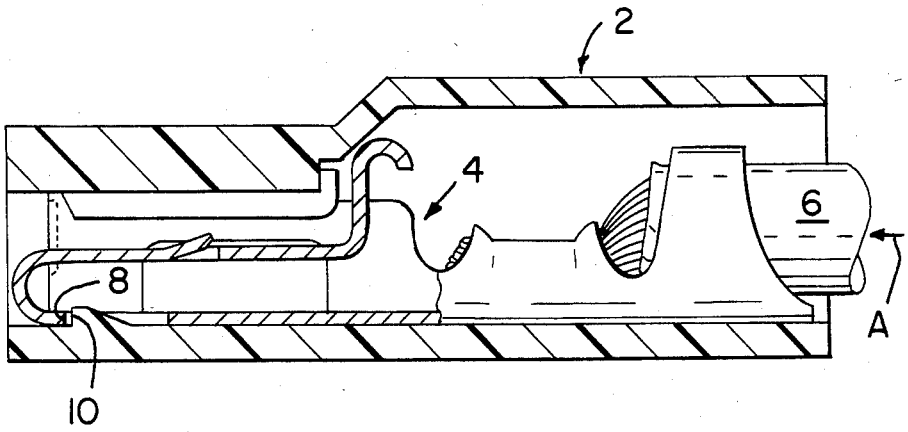
FIG. 11 is a perspective view illustrating an insulating sleeve and an electrical terminal adapted to be inserted into the sleeve and thereby automatically latched therein.

As shown in FIG. 11, an insulating sleeve in the form of a tubular plastic housing 2, for example made of nylon, receives an electrical terminal 4 which has been connected by crimping, to an electrical wire lead 6. As the terminal 4 is inserted into the housing 2, in the direction of the arrow A in FIG. 11, a shoulder 8 of the terminal 4, snaps behind an internal shoulder 10 defined by the housing 2 so that the terminal 4 is secured therein. Similar terminals and the housings are described in detail in U.S. Pat. No. 3,976,348 which is incorporated herein by reference.

The apparatus to be described is for the purpose of inserting terminals 4, which have been already crimped to the ends of wire leads 6, at a crimping station of an automatic lead making machine (not shown), each into a housing 4.

Figure 1:
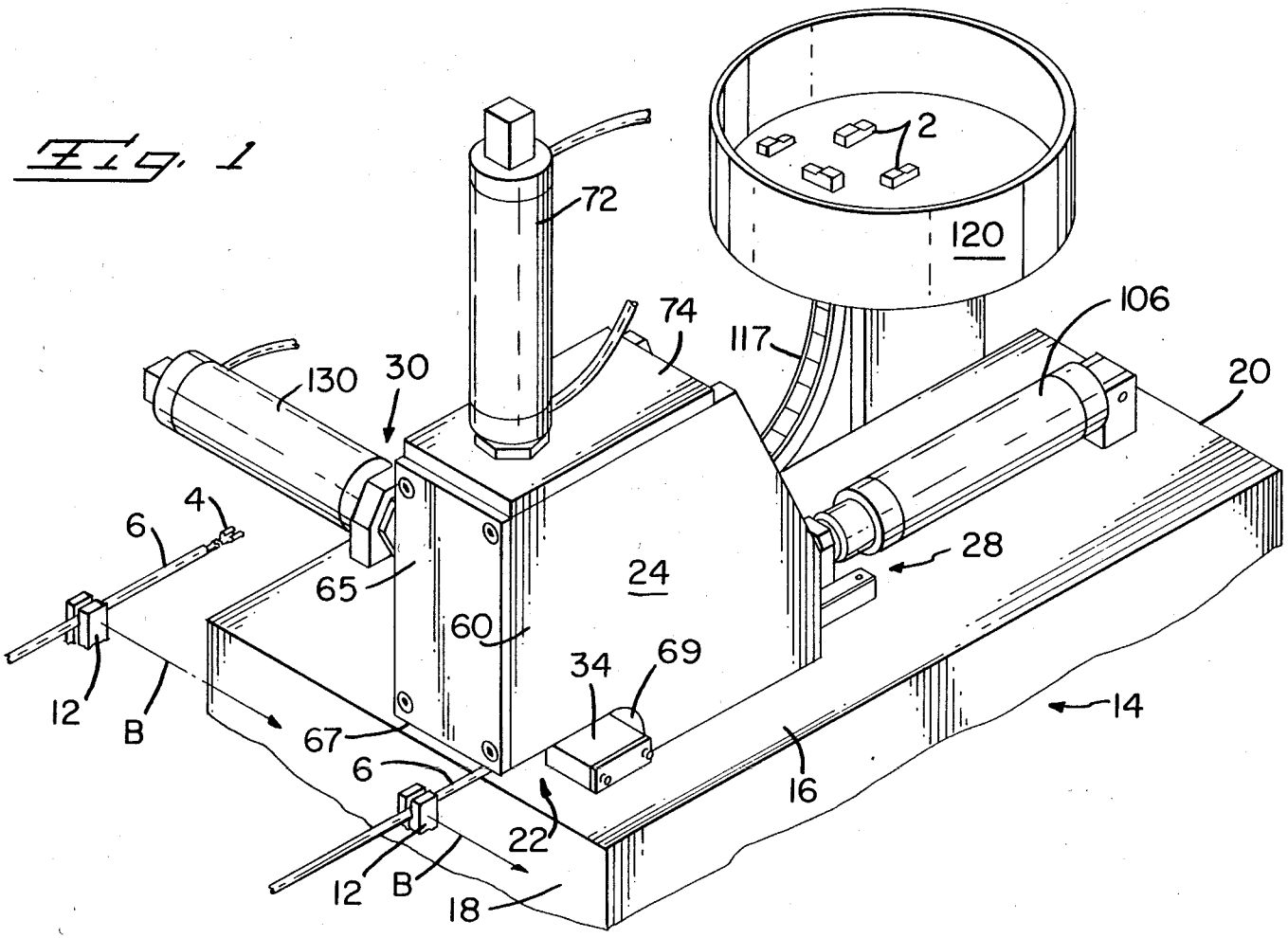
FIG. 1 is a perspective view of apparatus for applying insulating sleeves to electrical terminals connected to the ends of wire leads carried by a conveyor.

As will appear from FIG. 1, each lead 6, with a terminal 4 crimped thereto, is carried by a pair of jaws 12 of a conveyor of the lead making machine, the end portion of the lead 6, to which the terminal 4 is connected, projecting by a few inches from the jaws 12. The conveyor, which may be of the kind disclosed in U.S. Pat. No. 2,768,425 which is incorporated by reference herein, is advanced by the lead making machine step by step, the conveyor dwelling for a period of a little more than one second, for example, between steps. The leads 6 are transported by the conveyor in a horizontal direction normal to their longitudinal axes as indicated by arrows B in FIG. 1.

The apparatus comprises a frame 14 having a table 15 with an upper horizontal surface 16, the frame having a conveyor side 18 and a distal side 20, that is to say a side which is remote from the conveyor. A terminal locator 22 (best seen in FIGS. 2 and 8) is mounted on the surface 16 adjacent to the conveyor side 18 of the frame. A ram housing 24 also mounted on the surface 16 supports a lead capturing and terminal hold down member ram assembly 26 (best seen in FIGS. 2 and 2A). A sleeve applicator ram assembly 28 (best seen in FIG. 4) is mounted on the surface 16 on the side of the locator 22 nearest to the distal side 20 of the frame 14. A sleeve supply ram assembly 30 (best seen in FIGS. 4 and 5) is mounted on the surface 16 upon its left-hand (as seen in FIG. 1) side. An ejector ram assembly 32 is mounted to the table 15 under the locator 22.

The locator 22 comprises a pair of spaced housings 34 and 36 each slidably receiving a terminal positioning block 38 urged against an elongated rectangular terminal support, and sleeve support, block 40, by means of a spring 42. The housings 34 and 36 and the blocks 38 and 40 cooperate to define a cavity 41 having a floor 43, a first flared mouth 44 which opens upwardly towards the assembly 26, and oppositely opening second and third mouths 46 and 48, respectively, each of which opens in a direction at right angles to the mouth 44, the mouth 46 opening towards the assembly 28 and the mouth 48 opening towards the conveyor jaws 12. Each block 38 is slidable away from the block 40 against the action of its spring 42. Extending from the upper wall of the housing 36, is a terminal guide ramp 50 bridging the surface 16 and the upper surface 52 of the housing 36.

The ejector ram assembly 32 comprises a piston and cylinder unit 54 the cylinder of which is screwed into the table 15. A piston rod 56 of the unit 54, which constitutes an ejector ram, is movable through a central bore 58 in the block 40, and thus through the floor 43.

Figure 2:
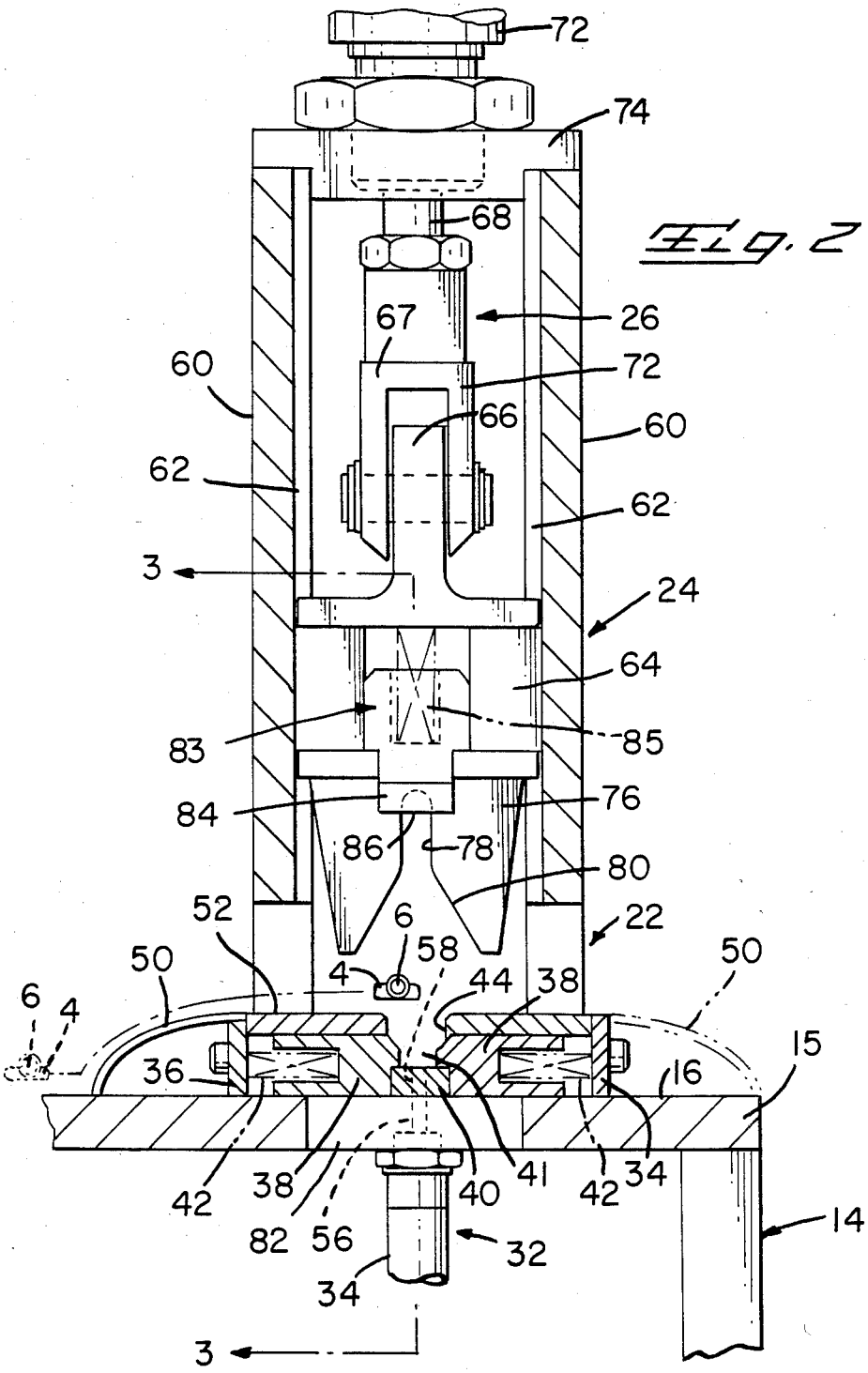
FIG. 2 is a frontal view of the apparatus prior to a cycle of operation thereof.
Figure 2A:
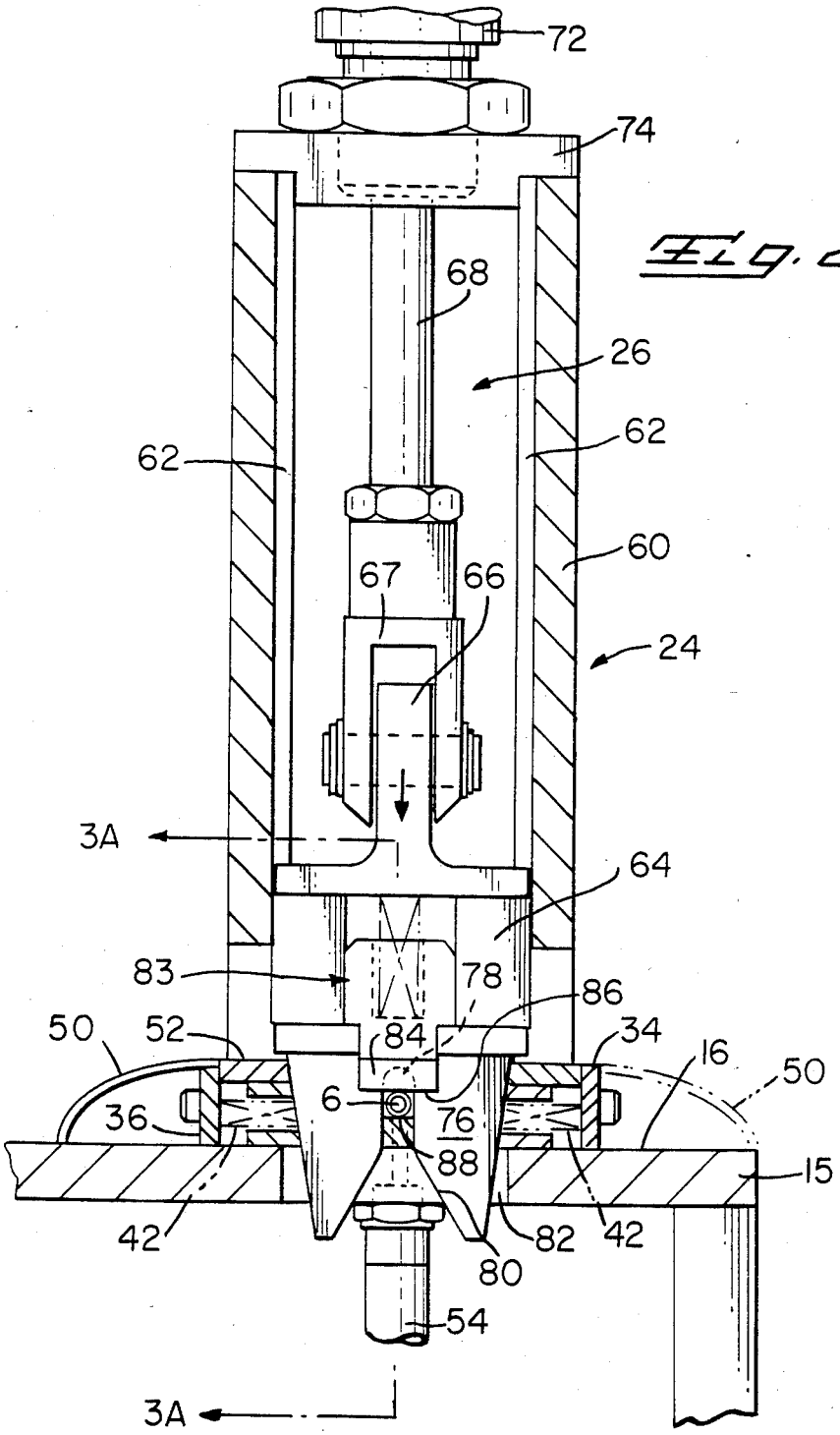
FIG. 2A is a similar view to that of FIG. 2 but showing the apparatus at a stage during the cycle of operation.
Figure 3:
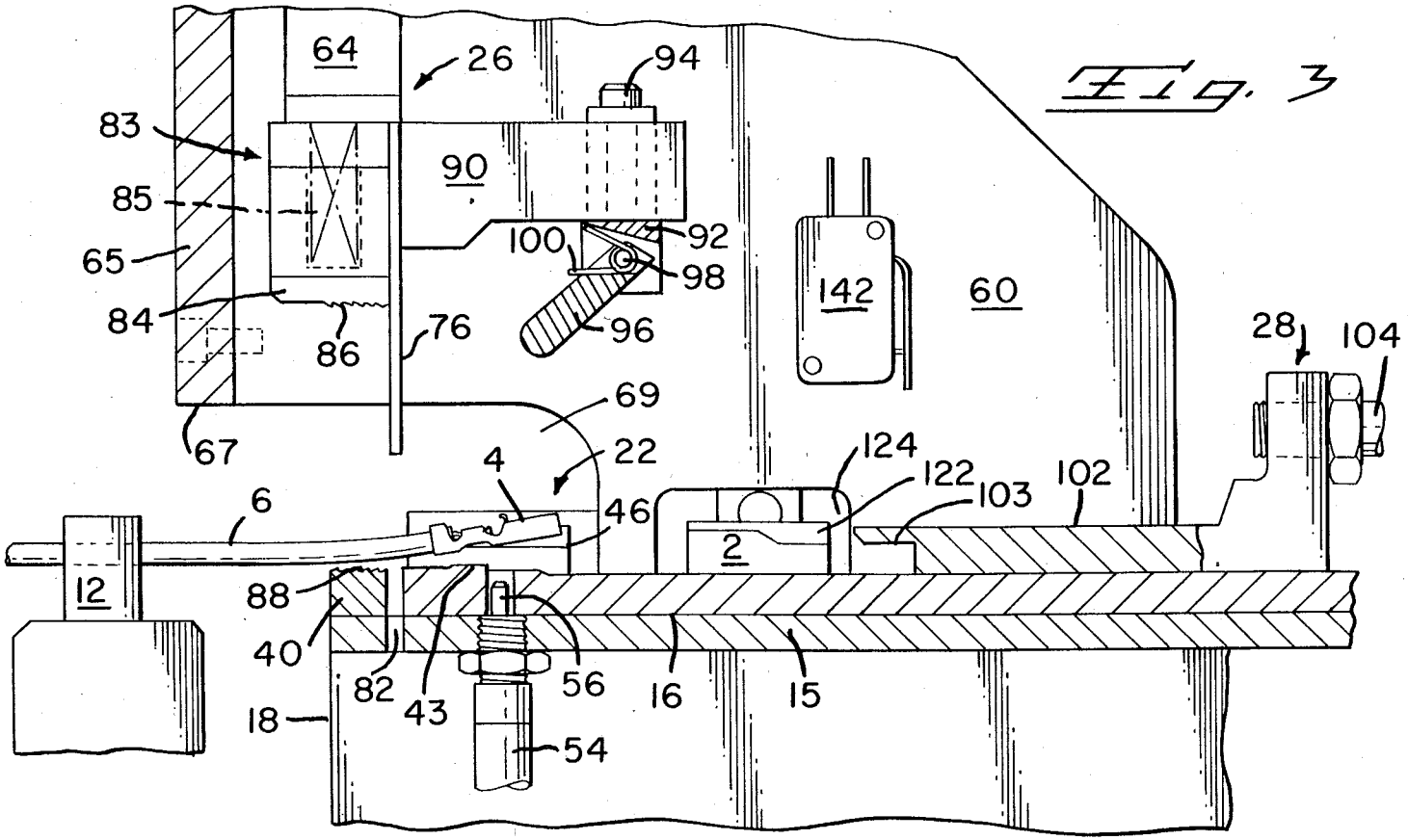
FIG. 3 is a view taken on the lines 3—3 of FIG. 2.
Figure 3A:
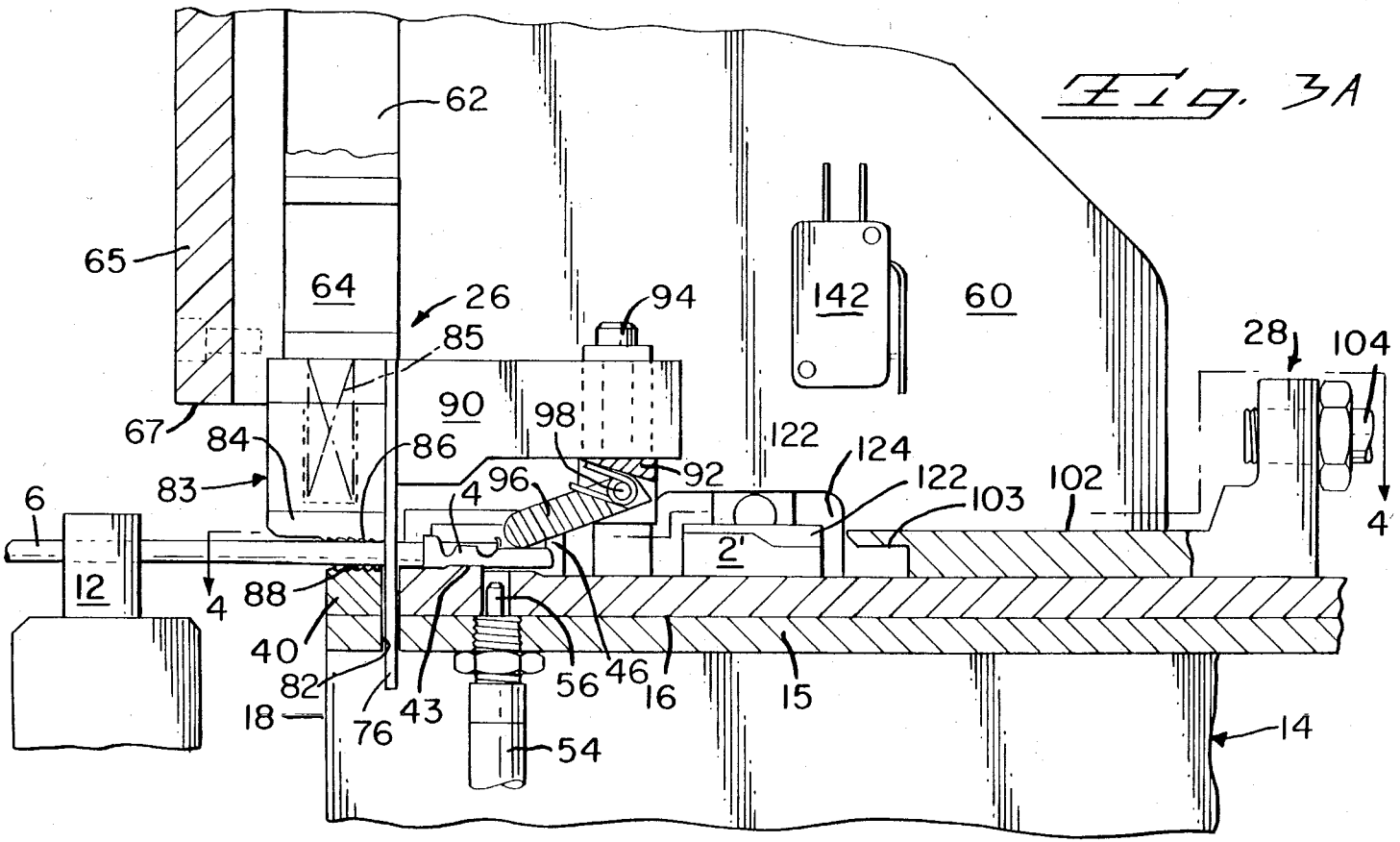
FIG. 3A is a view taken on the lines 3A—3A of FIG. 2A.

The lead capturing and hold down member ram assembly 26 comprises parallel frame plates 60 upstanding from the surface 16 and being provided with vertical guide grooves 62 along which a lead positioning member, and terminal hold down member, ram 64 is slidable. The ram 64 has a stem portion 66 secured in a clevis 67 mounted on the piston rod 68 of a piston and cylinder unit 72 mounted on a top cover plate 74 bridging the frame plates 60. A front plate 65 also bridging the plates 60, lies beyond the side 18 of the frame 14. The lower edge 67 of the plate 65 lies at a substantially higher level than the floor 43, as shown in FIGS. 3 and 3A, the plates 60 defining recesses 69 for the passage of the end portions of the leads 6. The ram 64 has fixedly mounted on its lower end, a lead capturing and positioning member in the form of a plate 76 formed with a slot 78 for snugly receiving a lead 6, and having a flared mouth 80 communicating with the slot 78 for guiding the lead 6 thereinto. The plate 76 is receivable in a slot 82 extending through the block 40 and the table 15. Secured to the forward side of the plate 76, i.e. its side nearest to the conveyor, is a lead gripper assembly 83 comprising a lead gripper block 84 loaded by a spring 85 and having a serrated lower surface 86 for cooperation with a similarly serrated surface 88 on the block 40. The surface 86 extends across the slot 78 in the vicinity of its base, as best seen in FIG. 2. Secured to the rear side of the plate 76, as shown in FIGS. 3 and 3A, is a hold down member carrier block 90 to which is secured a hold down member clevis 92 by means of a screw 94 by means of which the vertical position of the clevis 92 can be adjusted to allow for terminal size. A hold down plate member 96 is pivotally mounted in the clevis 92 on a pin 98 and is urged in an anticlockwise (as seen in FIGS. 3 and 3A) sense by a spring 100.

Figure 4:
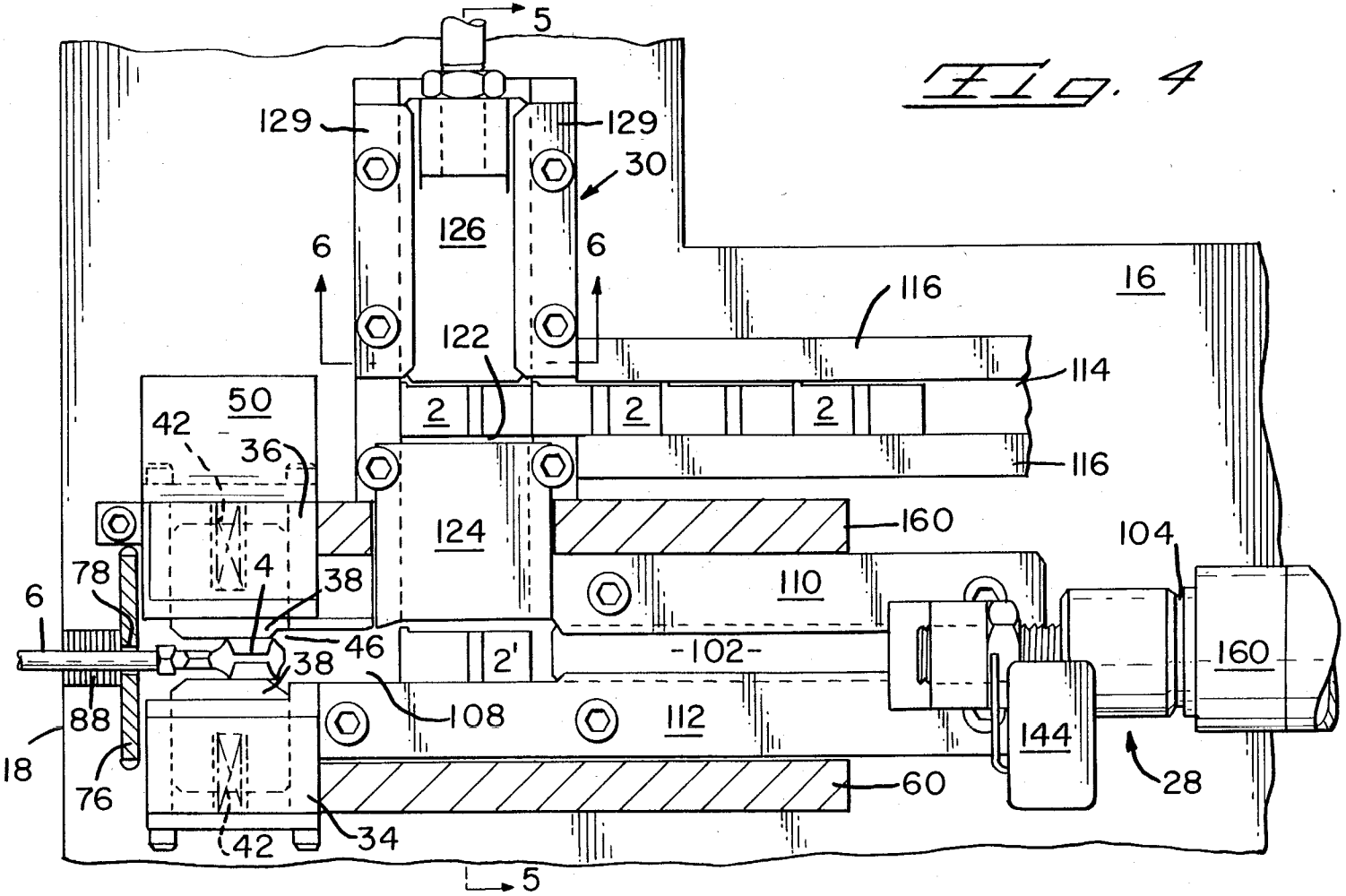
FIG. 4 is a view taken on lines 4—4 of FIG. 3A.

As best seen in FIGS. 3 and 4 the sleeve applicator ram assembly 28 comprises a sleeve applicator ram 102 connected to the piston rod 104 of a sleeve applicator piston and cylinder unit 106. A sleeve guide track 108 extends from the mouth 46 towards the ram 102. The ram 102 is guided along a path of movement towards and away from the mouth 46 between guide plates 110 and 112, the later providing one side of the track 108.

Figure 5:
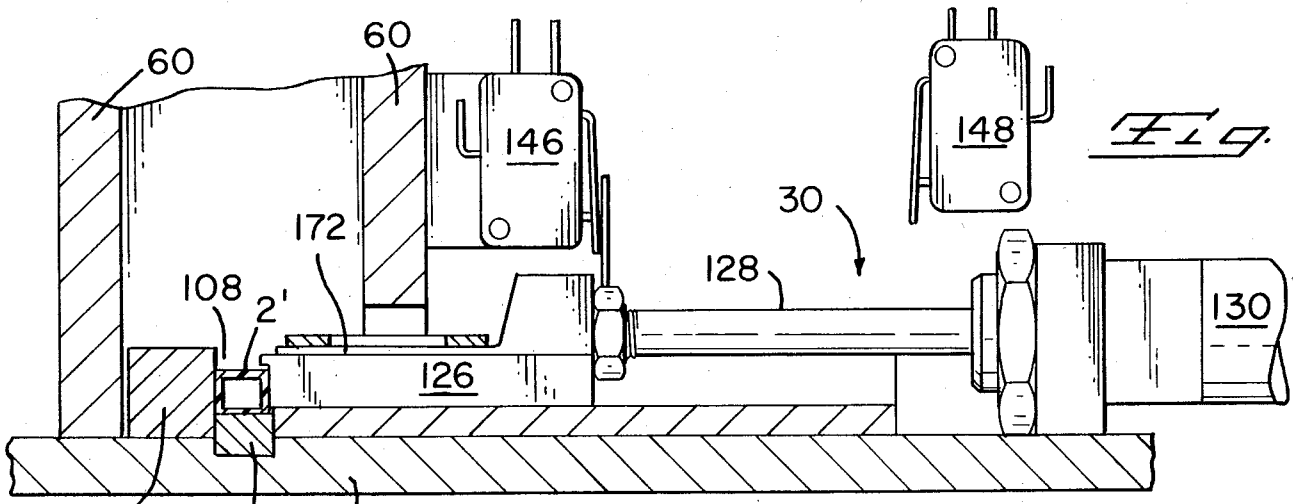
FIG. 5 is a view taken on lines 5—5 of FIG. 4.
Figure 6:
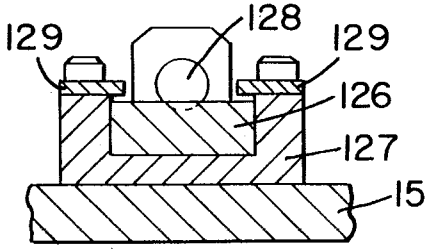
FIG. 6 is a view taken on lines 6—6 of FIG. 4.

The sleeve supply ram assembly 30 comprises (as best seen in FIGS. 4 and 5) a first sleeve feed track 114 defined by plates 116 on the surface 16, and one end of which communicates with the outlet track 117 (FIG. 1) of a source of supply of sleeves 2, in the form of a vibratory bowl feed device 120. The other end of the track 114 communicates with one end of a second sleeve feed track 122 extending at right angles to the trace 114 and having a cover plate 124. The other end of the track 122 communicates with the sleeve guide track 108. A sleeve feed ram 126 is connected to the piston rod 128 of a sleeve feed piston and cylinder unit 130 (FIGS. 1 and 5), the ram 126 extending at right angles to the ram 102 and being guided in a block 127 on the table 15, with the aid of guideplates 129 (FIGS. 4 and 6).

Figure 9:
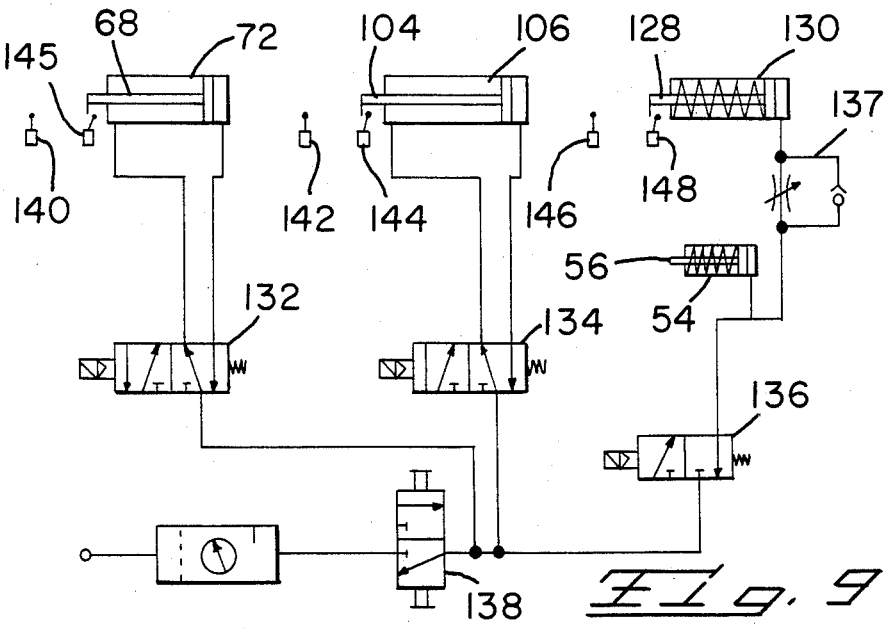
FIG. 9 is a diagram of a pneumatic circuit of the apparatus.

As shown in FIG. 9, the piston and cylinder unit 72, which is double acting, is actuable through a valve 132, the piston and cylinder unit 106, which is also double acting, being actuable through a valve 134 and the piston and cylinder units 54 and 130, which are single acting, being actuable through a common valve 136, the unit 130 being provided with a timeing adjustment device 137. When the advance of the conveyor is stopped, following each step forward, a first start signal from the lead making machine actuates a start switch (not shown) to cause pressure air to be supplied through a valve 138 and the valve 132, to the unit 72 to cause it to advance its piston rod 68 and thereby to actuate a limit switch 140 whereby the valve 134 is changed over to cause the unit 106 to advance its piston rod 104 thereby to actuate a limit switch 142 and to change over the valves 132 and 134 so that the units 72 and 106 retract their piston rods 68 and 104, respectively. At the end of its return stroke, the piston rod 104 trips a limit switch 144 causing the valve 136 to be changed over to cause the units 54 and 130, to advance their piston rods 56 and 128, respectively. At the end of its advance stroke the piston rod 128 trips a limit switch 146 thereby resetting the valve 136 and also causing a second start signal to be transmitted to the lead making machine, through a limit switch 145 which is closed by the piston rod 68 when in its retracted position, to cause the conveyor to be restarted. At the end of its return stroke, the piston rod 128 trips a limit switch 148 to reset the start switch.

Figure 10:
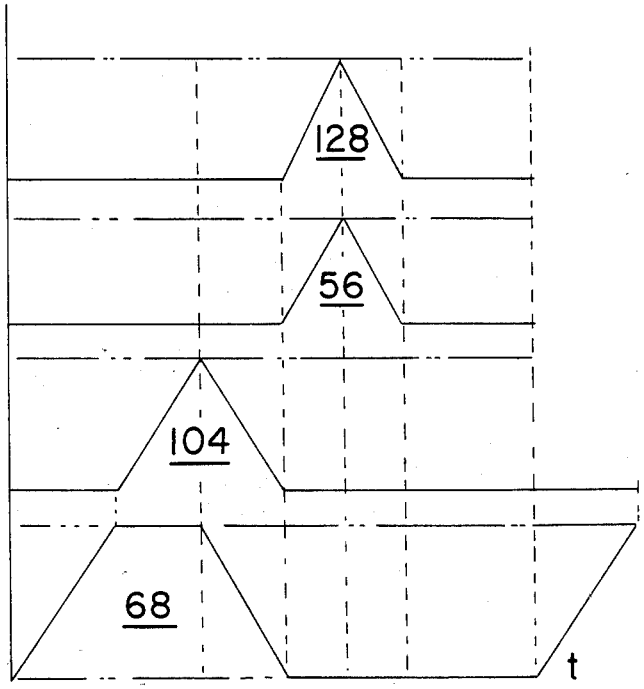
FIG. 10 is a diagram illustrating the sequence of operation of pneumatic piston and cylinder units of the apparatus.

FIG. 10 is a graph showing the movements of the piston rods 68, 104, 56, and 128, during a cycle of operation of the apparatus and of the conveyor in relation to a time base, t. As shown in FIG. 10, the piston rod 68 is advanced upon receipt of the first start signal, the piston rod 104 being advanced when the piston rod 68 has reached its fully advanced position, the piston rod 68 dwelling in its fully advanced position until the piston rod 104 has been fully advanced. Also as shown in FIG. 10, when the piston rod 104 has reached its fully retracted position, the piston rods 56 and 128 are driven to their fully advanced positions the conveyor is restarted at this time and after the piston rods 56 and 128 have been returned to their fully retracted positions, all the piston rods remain in their fully retracted positions until the end of the conveyor cycle, that is until the next first start signal causes the piston rod 68 to be advanced. The conveyor cycle lasts about two seconds, the cycle of the sleeve applying apparatus being completed in no more than one second.

Figure 8:
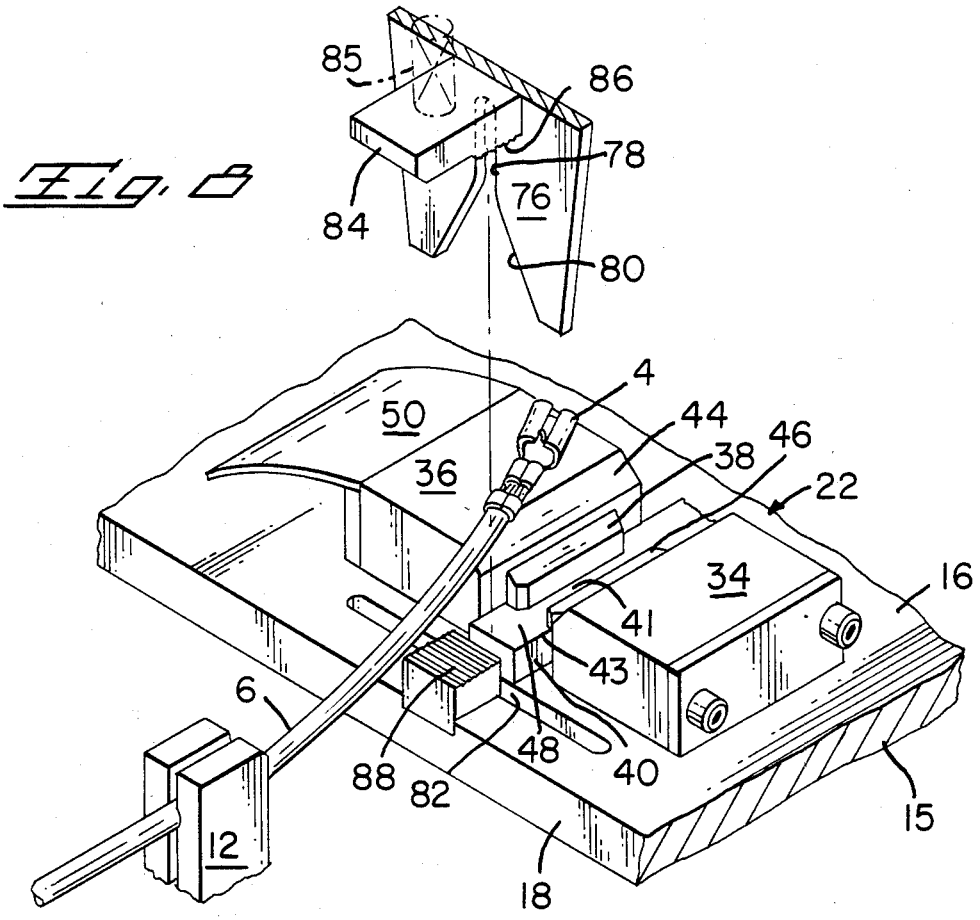
FIG. 8A is a perspective view of parts of the apparatus, illustrating the operation thereof.

During the advance of the pairs of jaws 12, prior to a first start signal being emitted, a terminal 4 on the end of a lead 6 grasped by a pair of the jaws, is moved by the motion of the jaws up the ramp 50 to fall into the mouth 44 in a random position, as will be apparent from FIGS. 2 and 8, when the conveyor is stopped. Upon the emission of the start signal, the piston rod 68 drives the plate 76 down, so that the lead 6 to which the terminal is connected, is captured by the walls of the mouth 80 and is gathered into the slot 78. The lead 6 is thereby grasped by the plate 76 at a position proximate to the terminal 4, whereby the terminal 4 is centered with respect to the mouth 44 so that it falls between the two blocks 38, coming to rest on the floor 43 as shown in FIG. 3A. During its descent, the plate 76 moves through the slot 82 in the block 40 and table 15, until the lead 6 is gripped between the serrated surface 86 of the spring loaded block 84 and the serrated surface 88 of the block 40, also as shown in FIG. 3A, the lead 6 extending through the mouth 48 of the terminal locator 22. The spring 85 ensures that the lead 6 is not so tightly gripped as to be damaged. As the block 90 descends with the plate 76, the spring loaded hold down member 96 engages the terminal 4, thereby being rotated in an anti-clockwise sense (as seen in FIG. 3A) against the action of its spring 100, whereby the terminal 4 is securely held down against the block 40 so as to be retained in a position of precise alignment with a housing 2' which has been fed into the guide track 108 towards the end of the previous cycle of operation of the apparatus.

Figure 3B:
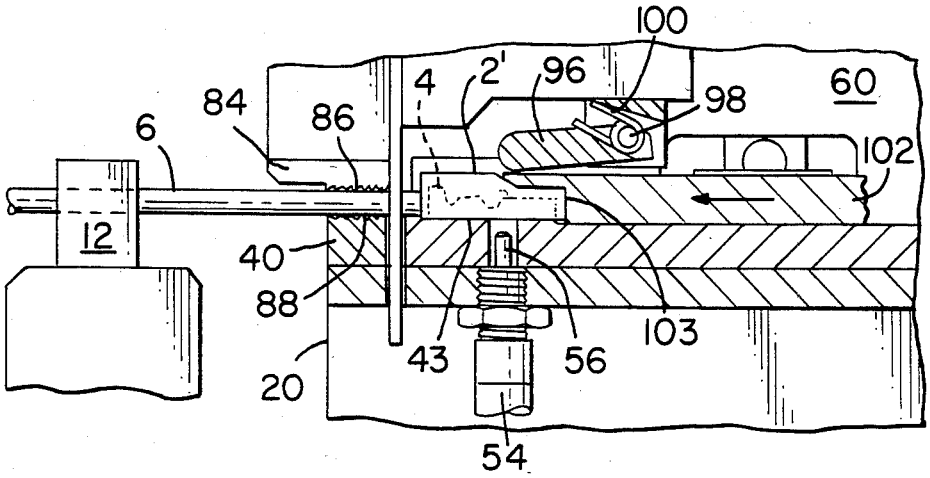
FIG. 3B is a fragmentary view illustrating parts shown in FIG. 3A at a later stage during the cycle of operation of the apparatus.
Figure 7:
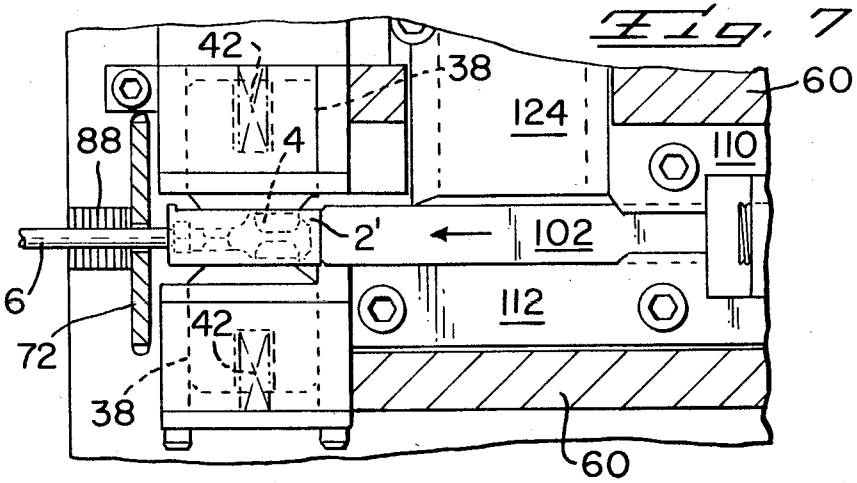
FIG. 7 is a fragmentary plan view partly in section showing some of the parts illustrated in FIG. 4, at a subsequent stage during the cycle of operation of the apparatus.

The piston rod 104 is now advanced, whilst the plate 76, and the blocks 84 and 90 continue to dwell in their down position. As the piston rod 104 advances, the housing 2 is received in a notch 103 in the housing applicator ram 102 and is thereby driven towards the mouth 46, displacing the hold down member 96 against the action of its spring 100, as shown in FIG. 3B, the sleeve 2' itself displacing the blocks 38 against the action of their springs 32, until the terminal 4 is fully received within the sleeve 2' as shown in FIGS. 3B and 7.

The piston rod 68 is now retracted so that the plate 76, the surface 86, and the hold down member are withdrawn from the terminal locator 22 to their FIG. 3 positions.

Figure 3C:
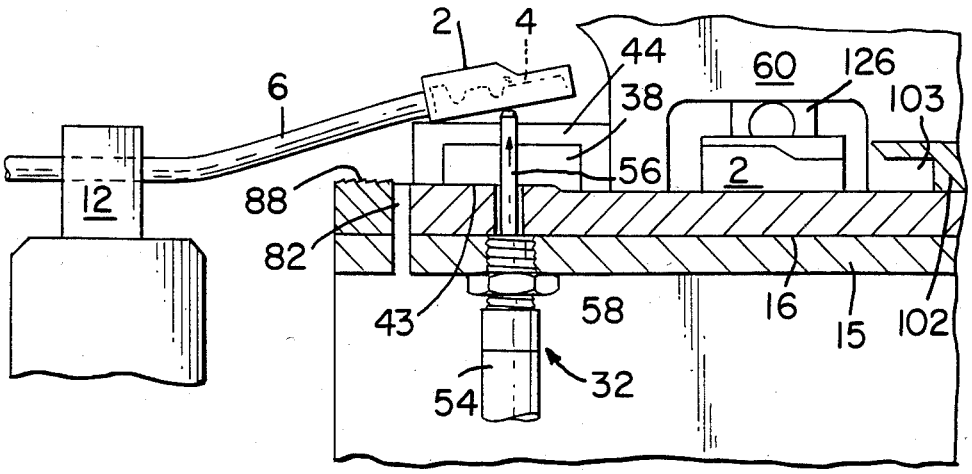
FIG. 3C is a similar view to that of FIG. 3B but illustrating the parts at a subsequent stage during the cycle of operation.

The piston rods 56 and 128 are now advanced simultaneously. The piston rod 56 thus moves up through the bore 58 in the block 40, that is to say through the floor 43 of the cavity 41 sharply to eject the terminal 4 with the housing 2' thereon vertically out of the cavity 41 through the mouth 44 as shown in FIG. 3C. Upon the emission of the second start signal, the conveyor is advanced again, so that the terminal 4 with the housing 2' thereon is thereby carried from the apparatus.

During the advance of the piston rod 128, the ram 126 thereon pushes a housing 2 which has been advanced down the track 114 under the action of the vibratory bowl feed device 120, into the track 122 in front of the ram 126 (as shown in FIG. 4), down the track 122 into a position in the track 128, between the mouth 46 and the ram 102 which is now in a retracted position (FIGS. 4 and 5). After the piston rods 56 and 128 have been retracted, the apparatus is ready for another cycle of operation is response to the next first start signal emitted by the lead making machine.

As shwon in broken lines in FIG. 2, the terminal guide ramp 50 may be arranged on the right-hand (as seen in FIG. 2) side of the locator 22 instead of upon the left-hand (as seen in FIG. 2) side thereof, where the leads 6 are to be conveyed from right to left (as seen in FIG. 2) instead of from left to right (as seen in FIG. 2) as described above.

I claim:

1. Apparatus for applying an insulating sleeve to an electrical terminal connected to an end of a wire lead, the apparatus comprising:

a frame;

means on the frame for locating the terminal in a given position;

means on the frame for capturing the wire lead proximate to the terminal and for then positioning the terminal in the locating means;

means on the frame for releasably retaining the terminal in the locating means;

means on the frame for then applying the sleeve to the terminal;

means on the frame for withdrawing the lead capturing and terminal positioning means and the retaining means from the locating means; and means on the frame for then ejecting the terminal, with the sleeve thereon , from the locating means.

2. Apparatus according to claim 1, and further comprising a sleeve supply source, and means for sequentially feeding sleeves from the source, to the sleeve applying means.

3. Apparatus as claimed in claim 1, in which the retaining means is arranged resiliently to engage the terminal.

4. Apparatus for applying an insulting sleeve to an electrical terminal connected to an end of a wire lead, the apparatus comprising:

a frame;

a terminal locator on the frame and defining a terminal receiving cavity having a floor and first and second mouths opening in orthogonal directions, the first mouth opening in a direction away from the floor;

a lead capturing and terminal positioning member and a terminal hold down member mounted on the frame for reciprocating movement towards and away from said first mouth;

a sleeve application ram mounted on the frame for reciprocating movement towards and away from the second mouth;

a feed device for inserting the sleeve between the second mouth and the application ram, so as to extend longitudinally thereof;

an ejector movable into the cavity;

drive units for said positioning and the hold down members, the ram, the feed device and the ejector; and means for controlling the operation of the drive units, whereby the feed device inserts the sleeve between the ram and the second mouth with the former in a retracted position, said positioning and hold down members are advanced towards the first mouth to position the terminal in the cavity and to urge it against the floor thereof, the ram is advanced to drive the sleeve through the second mouth and into the cavity to apply the sleeve to the terminal, said positioning and hold down members are retracted from the terminal locator and the ejector is moved into the cavity to eject the terminal with the sleeve thereon from the terminal locator.

5. Apparatus as claimed in claim 4, in which said positioning member is formed with a slot for snugly receiving the wire lead and with a flared mouth communicating with the slot for guiding the lead thereinto.

6. Apparatus as claimed in claim 5, in which said positioning member is movable into an advanced position in which the floor of the cavity is opposite to the slot, the terminal locator having an opening opposite to the second mouth and communicating with the cavity and with the first mouth, so as to be capable of receiving the lead, as the positioning member is moved to its advanced position.

7. Apparatus as claimed in claim 4, in which the hold down member is spring loaded and the cavity has spring loaded sidewalls adapted to be moved resiliently away from one another by engagement with the sleeve as it is inserted into the cavity through the second mouth.

8. Apparatus as claimed in claim 4, in which the ejector is movable through the floor of the cavity, towards the first mouth.

9. Apparatus as claimed in claim 4, in which the positioning and hold down members are driven by a first piston and cylinder unit, the ram, the ejector and the feed device being driven by individual second, third and fourth piston and cylinder units respectively.

10. Apparatus as claimed in claim 9, in which the piston of the first unit is arranged, when fully advanced, to cause the piston of the second unit to be advanced, the piston of the second unit being arranged, when in a fully advanced position, to cause the piston rod of the first unit to be retracted and upon subsequently reaching a fully retracted position, to cause the pistons of the third and fourth units to be advanced.

11. Apparatus for applying insulating sleeves to electrical terminals, each connected to an end of a wire lead carried by a conveyor in a horizontal direction normal to the longitudinal axis of the lead, the apparatus comprising:

a frame having a horizontal surface and having a conveyor side and a distal side opposite thereto;

a terminal locator mounted on said surface adjacent to said conveyor side and defining a terminal receiving cavity having a floor, a vertically opening, flared, first mouth and a horizontally opening, second mouth facing said distal side;

a lead capturing positioning member mounted on said surface for vertical movement towards and away from the first mouth along a path of travel extending between the terminal locator and the conveyor side of the frame and being proximate to the terminal locator;

a terminal hold down member mounted on said surface for vertical movement towards and away from the first mouth along a path of travel extending into the cavity;

a sleeve applicator first ram mounted on said surface between the terminal locator and the distal side of the frame, for movement towards and away from the second mouth along a path of travel extending thereinto;

a sleeve guide track mounted on said surface and extending from the said second mouth along the path of travel of the first ram;

a sleeve feed second ram mounted on said surface for horizontal movement along a path of travel extending transversely of that of the first ram;

a sleeve feed track communicating with, and extending transversely of said sleeve guide track;

an ejector third ram movable through said floor along a path of travel extending into the cavity;

means for driving the positioning and hold down members and said rams; and means for controlling the operation of said drive means, to cause each terminal in turn to be inserted into the cavity and held down therein, a sleeve to be applied to the terminal by the first ram and the terminal with the sleeve thereon subsequently to be ejected from the cavity through the first mouth by the second ram.

* * * * *